United States Patent [19]

Winters

[11] Patent Number: 5,063,684

[45] Date of Patent: Nov. 12, 1991

[54] MARKING TEMPLATE FOR PLACEMENT OF COLLAR INSIGNIA

[76] Inventor: Kersten Winters, 715 N. 42nd St., #107B, Grand Forks, N. Dak. 58203

[21] Appl. No.: 580,865

[22] Filed: Sep. 11, 1990

[51] Int. Cl.[5] ..... A41H 3/01

[52] U.S. Cl. ..... 33/653; 33/645

[58] Field of Search ..... 33/653, 644, 645, 662; 2/246; 40/1.5

[56] References Cited

U.S. PATENT DOCUMENTS

| | | | |
|---|---|---|---|
| 2,387,986 | 10/1945 | Evans . | |
| 2,681,511 | 6/1954 | Seton | 33/653 |
| 2,821,787 | 2/1958 | Shepard . | |
| 2,834,129 | 5/1958 | Kirkbride | 40/1.5 |
| 2,847,773 | 8/1958 | Herrick | 2/246 X |
| 3,092,915 | 6/1963 | Bell | 33/653 |
| 3,376,651 | 4/1968 | Carey . | |
| 4,302,884 | 12/1981 | Pallone . | |

*Primary Examiner*—Harry N. Haroian

[57] ABSTRACT

A marking template (A) that operates in combination with collar insignia (14) in which its spikes (15) serve as a marking device. Thus its title is derived from its primary function of marking the position for the placement of collar insignia. Template (A) is a flat, thin, rigid, triangular shaped device. Located at predetermined distances from either of two bases (6) and (7) are two triangular edge positioning notches (4) and (5). These unique edge positioning notches (4) and (5) are used to align and center template (A) on the uniform collar. In addition there are a plurality of die cut incisions (12) arranged in sets of two die cut incisions (13) to accommodate the insertion of collar insignia (14) for all enlisted insignia of grades of the U.S. Marine Corps. When the insignia (14) is inserted into one set of two die cut incisions (13) corresponding to a specific rank (18), the insignia spikes (15) then becomes a part of the physical feature of the marking template (A). Once the uniform collar material is pierced by the insignia spikes (15), the combined template (A) and insignia (14) is removed, leaving small holes in the uniform collar for later placement of the insignia (14).

8 Claims, 1 Drawing Sheet

MARKING TEMPLATE FOR PLACEMENT OF COLLAR INSIGNIA

BACKGROUND

1. Field of Invention

This invention relates to templates, specifically to a template for marking the exact position for the placement of collar insignia on military uniforms.

2. Discussion of Prior Art

The military promulgates rules and regulations regarding dress, and more specifically, sets forth the specifications for the positioning of collar insignia on the uniforms of enlisted marines. For example, the insignia of grade, plastic or metal is worn on each side of the collar of the utility or field coat and khaki shirt with service sweater, (1) placed vertically with the single point up, and (2) the center of the insignia on a line bisecting the angle of the point of the collar, with (3) the lower outside edge being equally spaced ½ inch from either side of the collar.

Heretofore, military personnel used a variety of methods for sighting the positioning of insignia in order to comply with the rules. These methods were at best difficult, inefficient and subject to human error that is associated with visual estimation and the use of inexact reference devices.

Therefore, inventors have created alternative devices, more specifically reference templates, to assist military personnel in complying with the rules for the exact placement of insignia. For example, U.S. Pat. No 2,387,986; entitled "Insignia Positioning Device" issued Oct. 30, 1945 to Evans discloses a flat, plastic, transparent, rectangular device with two rectangular openings having a centrally located vertical line and a horizontal line with fine line graduations thereon for ruler-like measuring and alignment of the rectangular openings as specified in the rules for correct positioning of insignia. When the rectangular opening is aligned according to the rules, the insignia may be inserted through the opening and attached to the uniform. The device can thereafter be lifted over the insignia without disturbing the attached and correctly positioned insignia.

U.S. Pat. No 2,681,511; entitled "Template For Locating Collar Insignia" issued June 22, 1954 to Seton discloses a flat, plastic device shaped to correspond to the pointed tab of the collar. There are two slots spaced to correspond to the spacing of the pins of the insignia and these slots lead to small openings. The template is then laid on the collar and the insignia is inserted through the openings and passed through the collar and then secured in this position. The template can be withdrawn from the pins by way of the two slots.

U.S. Pat. No. 3,376,651; entitled "Insignia Positioning Devices" issued Apr. 9, 1968 to Carey discloses a device having a channel-shaped clip-on neckline edge for removably securing the device in position on the uniform. The device has upper and lower edges perpendicular to the neckline edge and between which there is a parallel slot. A carrier is longitudinally slidable within the slot. A positioning guide projects downwardly from the carrier below the device while a centering arm is mounted on the carrier and above the device. The clip-on edge is secured to the uniform neckline with the positioning stud in the vertex of the acute angle of the collar-lapel portion of the uniform. The upper and lower insignia are positioned against the upper and lower edges of the device and centered using the centering arm. The centering arm which is pivotally and slidably mounted can be moved within the longitudinally slot to locate the correct position and then pivoted out of the way to keep from hindering insignia placement.

U.S. Pat. No. 4,302,884; entitled "Insignia Positioning Template" issued Dec. 1, 1981 to Pallone discloses a flat, plastic, rectangular device with a vertical line marked thereon; one or more edge positioning guidelines marked thereon and one or more longitudinal, horizontal slots thereon. The device includes a stud protruding above and below and in the plane of the center line. The center line and/or edge positioning guidelines are for aligning the device substantially parallel with respect to the uniform neckline. The horizontal positioning lines are for positioning the upper and lower edges of the respective insignias at a predetermined distance below and above the stud in the center line. The horizontal slots are designed for receiving one or more spikes of an insignia to be positioned and adapted for slidably removing the device when the insignias are in place.

Whereas a number of aids have been developed to assist military personnel in complying with the rules for placement of insignia, their use is not commonplace. Heretofore, all devices invented have depended upon the traditional way of thinking; in that the devices described, function as reference templates. Their sole purpose is to locate the position for the collar insignia, using a combination of reference points to align and center the devices. Once the position is located, the insignia is then inserted in an opening or slot. The device is then removed by way of the opening or slot after the insignia is securely attached to the uniform. Thus, alignment of the devices require an elaborate matching process to accomplish their stated purpose.

In addition, most of the devices require that one hand be used to guide and hold the template in position while the other hand is used for insertion of the insignia. Concentration is divided between keeping the device aligned and the act of inserting the insignia. Thus, errors in placement may occur due to distractions created by concentrating on several functions simultaneously.

No claim can be made for these devices to be acknowledged as marking templates due explicitly to the physical structure. All devices describe openings or slots which allow for play between the insignia spikes, and does not provide a foundation around the spikes to hold them stable. Unstable spikes will have a tendency to move, waver or change its position before it reaches its goal, thereby allowing the insignia to be improperly and/or not uniformly placed.

All devices described herein are rectangular in shape except for one which is described as being collar shaped. It can be demonstrated that no two collars are shaped exactly the same, and thus a device designed to conform to the shape of the collar will not be flexible enough to accommodate variations due to different uniform types.

While the known devices are meant to simplify the placement of insignia they tend to be awkward and cumbersome, thereby contributing to their difficulty to operate. The degree of difficulty has a direct relationship to the amount of time needed to accomplish the task. In addition most of the devices have tended to be expensive. Therefore visual estimation, along with individual inventiveness are most typically used as reference devices for the positioning of military insignia.

Thus, the search continues for a simple, easy, inexpensive and timesaving device to assist military personnel in complying with the rules for the placement of insignia.

OBJECTS AND ADVANTAGES

My invention is an inexpensive, easy to operate template for marking the exact position for the placement of collar insignia. Its unique triangular design with edge positioning notches incorporates the insignia spikes to piece the cloth, thereby marking the position for the placement of collar insignia.

Accordingly, besides the objects and advantages described above, several objects and advantages of the present invention are:

(a) the structure is simple to construct, utilizing a printing press operation to create multiple face cards on a sheet of paper which are then laminated to provide a stiff consistency. Finally, the individual units are cut using a die cut process that creates the design of the template and the plurality of die cut incisions for the insignia spikes.

(b) the simple construction, utilizing the above production processes, allows this device to be mass produced to meet consumer demand. In addition the use of low cost materials keeps production costs down, thus making the device inexpensive.

(c) the design of the template allows the use of insignia spikes to be adapted as a physical feature. They are able to cause a mark by piercing the collar material, leaving small holes in the uniform collar at the precise position for eventual placement of insignia. Other marking devices could be incorporated into the design, but the use of the insignia spikes keeps the cost of the device down and serves the same function.

(d) the unique one piece design makes the device easy to operate.

(f) the use of die cut incisions that are limited in size to permit insignia spikes to be forcibly pushed through die cut incisions, puncturing a hole in the surface of template. With insignia removably mounted on top of template, insignia spikes fit snugly in spike created puncture holes which provides a secure foundation around the insignia spikes, providing support and stability to the spikes when marking. Support and stability of insignia spikes prevents shifting of metal spikes due to stiffly, starched collar material thereby causing proper and uniform placement of insignia.

(g) the operation allows for the use of both hands in aligning, centering and marking the position of collar insignia. Thus concentration is limited to the specific operation at hand as it is done in sequence. Undivided attention to the specific function of marking the position eliminates errors in the placement of collar insignia.

(h) the unique triangular design with its triangular notches on both sides allows easy and accurate alignment and centering of the template on the collar. The unique edge positioning notches indicate the reference points for alignment, allowing for visualization of the collar material.

(i) the unique triangular design agrees with the collar shape but does not conform to it. This allows placement of insignia accurately on collars regardless of uniform type because it is able to compensate for variations associated with all the uniform types used in the U.S. Marine Corps. The design allows for universal use on a variety of collar types.

(j) the plurality of die cut incisions in sets of two allows this device to be used as a marking template for the placement of insignia in a multitude of marking positions corresponding to the specifications of different insignia of grades. Thus, the template serves as a multifunctioning marking device.

Further objects and advantages will become apparent from a consideration of the ensuing description and drawings.

BRIEF DESCRIPTION OF DRAWING

My invention should become fully apparent from the detailed description along with its accompanying drawings wherein.

DETAILED DESCRIPTION

Template A is comprised of a single sheet of paper with references to ranks 16 of enlisted military personnel in the U.S. Marine Corps printed thereon which is referred to as face card B. Face card B is laminated, giving the device a relatively stiff consistency. Lamination also makes template A durable; and therefore, the ablility to withstand continued use. Other materials could be used that will give it the same thickness and rigid consistency, but laminated paper provides the correct thickness, consistency, durability and is inexpensive. Multiple die cut incisions 12 arranged in sets of two die cut incisions 13 are cut into template A at the same time the unique design is created.

Figure 1:
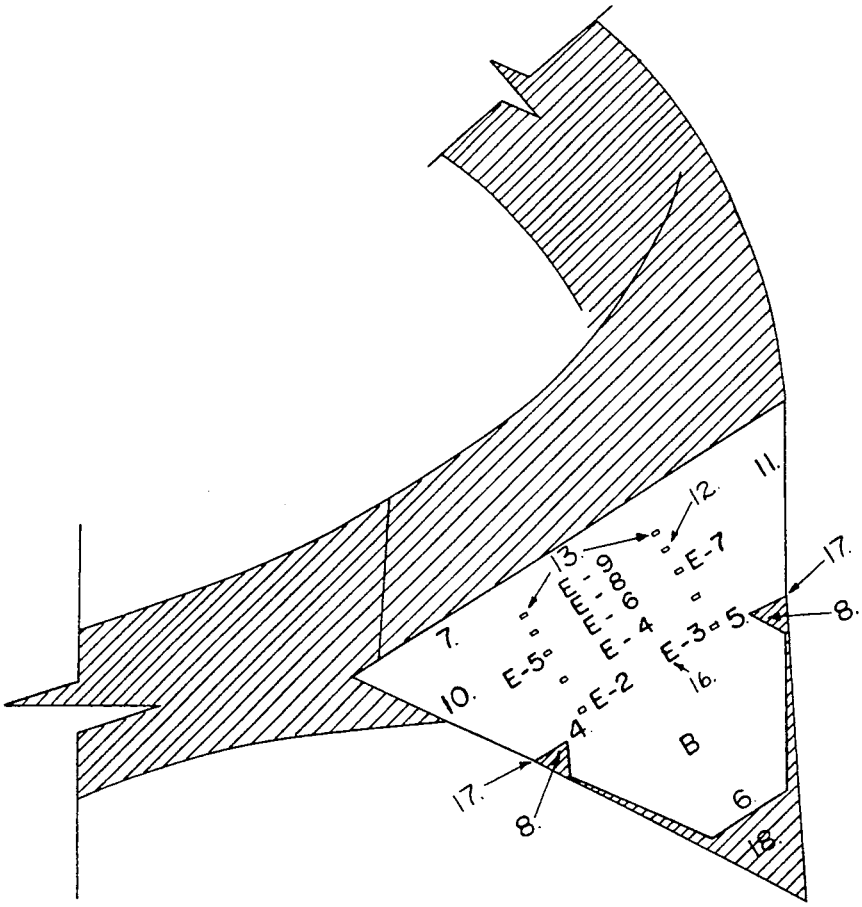
FIG. 1 is a plan view of the device shown over a uniform collar.

FIG. 1 shows the outline of template A lain over the shaded outline of a typical military uniform collar C with the collar material 8 showing through two edge positioning notches 4 and 5. The device is triangular in shape, even though the apex 6 of the triangle is cut off. This in effect gives template A two bases of different lengths 6 and 7. Diverging from the smaller of its two bases 6, its sides 10 and 11 angle outward to meet the larger base 7. Thus the design still retains its triangular shape. Along two sides 10 and 11 of template A at a predetermined distance from either of two bases 6 and 7 are triangular edge positioning notches 4 and 5. FIG. 1, with die cut incisions 12, more specifically, sets of two die cut incisions 13 are located at predetermined intervals according to the various ranks 16 for enlisted military personnel of the U.S. Marine Corps. A set of two die cut incisions 13 permits the insertion of the insignia spikes 15 according to the specific rank 16 through them so that insignia spikes 15 can be adapted theoretically as a part of the physical structure of the device.

Figure 2:
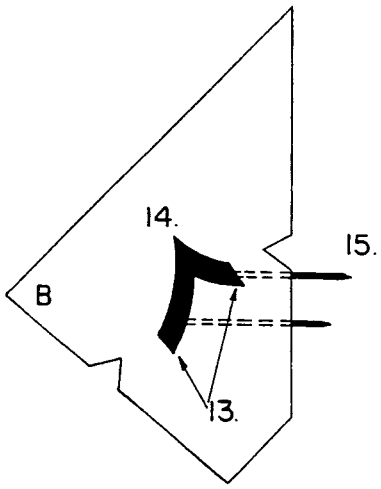
FIG. 2 is an oblique view showing the front of the template with an insignia in place ready for marking.

FIG. 2 shows an oblique view of template A, showing the front side of face card B with an insignia 14 secured into place through a set of two die cut incisions 13 with the insignia spikes 15 protruding from the back side D.

Figure 3:
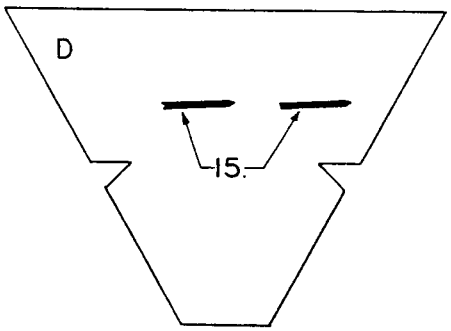
FIG. 3 is a rear view showing the insignia spikes protruding out the back side.

FIG. 3 is a rear view showing the back side D of template A with protruding spikes 15. FIG. 2 and 3 demonstrates the simple operation of the device as a marking template using insignia spikes 15 adapted as a physical feature of template A.

OPERATION OF INVENTION

The manner of using the marking template for the placement of collar insignia is to first push insignia spikes 15 through a set of two die cut incisions 13 in face card B corresponding to the user's rank 16. Pressure is exerted on insignia 14 causing insignia spikes 15 to puncture the surface of template A through a set of die cut incisions 13. Now insignia 14 is removably mounted on template A with insignia spikes 15 protruding from back side D. Next, with insignia spikes 15 protruding from back side D, as shown in FIG. 3, a combined template A and insignia 14 can be aligned and centered over collar C. This is done by using edge positioning triangular notches 4 and 5. These unique edge positioning notches 4 and 5 afford a visual reference, allowing visualization of collar material 8 through triangular notches 4 and 5. When collar material is flush 17 with the top of edge positioning notches 4 and 5, and template A bisects the angle of the point of collar 18, template A is aligned and centered accurately.

Now hold combined template A and insignia 14 and collar C between both hands. Next with both thumbs over insignia 14 exert sufficient pressure until insignia spikes 15 pierce the collar material underneath.

After marking the position, combined template A and insignia 14 is removed from the collar. By piercing the collar material insignia spikes 15 will leave small holes in the collar material, thus marking the position for the placement of collar insignia 14. Insignia 14 is then removed from template A. Now insignia spikes 15 can be inserted into the holes left in the collar. Thus, the simple operation of a marking template described herein easily, accurately and uniformly marks the position for the placement of collar insignia.

SUMMARY, RAMIFICATIONS AND SCOPE

Accordingly, it can be seen that a marking template for the placement of collar insignia can be used without difficulty. The simple operation described herein easily, accurately and uniformly marks the position for the placement of collar insignia for enlisted personnel in the U. S. Marine Corps. Furthermore the marking template has additional advantages in that

- it is easy to manufacture, using a printing press, laminating and die cut process which lends itself to mass production.
- allows the use of low cost materials to be used in its construction.
- provides an easy, accurate and uniform means of alignment and centering because of its one piece design and unique edge positioning notches.
- provides a stable, simple to operate, timesaving device for uniformly and accurately marking the position for placement of collar insignia regardless of uniform type; it compensates for the variations associated with all the uniform types used in the U.S. Marine Corps; and
- provides for the placement of the collar insignia for enlisted ranks in the U.S. Marine Corps, and thus serves as a multifunctioning device.

Although the description above contains many specifics, these should not be construed as limiting the scope of the invention but as merely providing illustrations of some of the presently preferred embodiments of this invention. For example the proposed design should not be limited to using the insignia spikes to mark the position for placement of collar insignia. Spike-like projections could be a fixed physical feature of the device. While the sets of two die cut incisions are arranged specifically for insignia of grades for enlisted personnel of the U.S. Marine Corps, the arrangement could be modified to accommodate officer ranks as well as ranks for other branches of the Armed Forces. In addition, the template can have other shapes, but the triangle most agrees with while not conforming to the shape of the collar.

Thus the scope of the invention should be determined by the appended claims and their legal equivalents, rather than by the examples given.

I claim:

1. A template for marking the position for the placement of collar insignia comprising a thin, rigid, planar member with rank indicia printed thereon, edge positioning cutouts located at a predetermined distance along each of two sides of said member, and a plurality of pilot passage means precut into the surface of said member at said rank indicia for allowing said collar insignia with two sharp pointed spikes to pierce the surface of said member, said member is a triangle with the apex cutoff giving said member two bases of different lengths while still retaining its triangular shape having said cutouts located at predetermined distances along each of two sides between said two bases with a plurality of said passage means precut into surface of said member relative to said cutouts, being adapted to be lain over collar, the slant of both sides of said member being disposed to agree, but not conform to the shape of the collar; the improvement wherein said passage means are arranged in sets of two at predetermined intervals to correspond to the spacing between the spikes of said insignia, being located on said surface of said member relative to said cutouts for a plurality of ranks, said template being adapted to be lain over a collar being positioned so that collar material is flush with top outer edges of said cutouts and said template bisects the angle of the point of collar and, said passage means further characterized as being die-cut incisions on the surface of said member adapted to permit said collar insignia to be forcibly pushed through the surface of said member when pressure is exerted, causing two spike created puncture holes in said member, wherein said holes being limited in size and having such a degree of constriction so as to be able to lock said device securely in place, providing support and stability to said device being adapted as a marking means for making two small holes in said collar material to mark the location for placement of the collar insignia thereafter, whereby said template is able to adapt said device as an integral second member to mark the precise location of collar insignia when said template is positioned on said collar by being moved along collar edges until top outer edges of said cutouts are flush with collar material, leaving two small holes therein for the placement of collar insignia thereafter.

2. The template of claim 1 wherein said member is made of a substrate of paper with rank indicia printed thereon, said substrate of paper being laminated with a thin plastic coating on both planar surfaces thereafter, said rank indicia being reference points for said passage means, located relative to said cutouts.

3. The template of claim 1 wherein said die cut incisions, are arranged in sets of two, being positioned to correspond to a plurality of ranks and calibrated relative to said cutouts when said collar material is flush with top outer edges of said cutouts said incisions being imperceptible therethrough cuts in the surface of said member, being adapted to accept the distal tip of said spikes and being disposed to permit said spikes to be forcibly pushed through the surface of said member.

4. A method for creating a mark on a uniform collar for placement of collar insignia comprising the steps of pushing a marking means for marking the precise location for said insignia through passage means being adapted for allowing said marking means to pass through the surface of a thin, rigid, planar template, positioning said member so that collar material is flush with top outer edges of edge positioning cutouts and said member bisects the angle of the point of the collar, and piercing collar material when pressure is exerted against said marking means, making two small holes in said collar material therein.

the improvement wherein said marking means is pushed through said passage means which are arranged in sets of two at predetermined intervals to correspond to the spacing between the spikes of collar insignia and located on said member relative to edge positioning cutouts for a plurality of ranks, said template being adapted to be lain over a collar, being aligned and centered by moving said template along the edges of said collar until said collar material is flush with the top outer edges of said cutouts and said template bisects the angle of the point of the collar, said passage means further characterized as being imperceptible cuts adapted to accept a device having two sharp pointed spikes being pushed through said cuts when pressure is exerted on said device, creating two puncture holes of limited size and degree of constriction so as to conform to size and shape of said spikes thereby providing support and stability when piercing collar material whereby said template being able to hold securely in place said device as an integral second member, preventing shifting and bending of said spikes when marking the precise location for the placement of collar insignia on said uniform collar thereafter.

5. A method for creating a mark of claim 4 wherein said spikes are forcibly pushed through a set of die cut incisions precut into surface and being located on said member relative to said cutouts for a plurality of ranks.

6. A method for creating a mark of claim 4 wherein said incisions are precut into surface of said member which is made of a substrate of paper with rank indicia printed thereon and laminated with a thin plastic coating of plastic on both sides of planar member thereafter.

7. A method for creating a mark of claim 4 wherein said member being positioned over a collar agrees with, but does not conform to shape of collar, said member being a triangle with apex cutouff giving said member two bases of different lengths while still retaining its triangular shape.

8. A method for creating a mark of claim 4 wherein said triangular shaped member is further positioned over said collar by moving said member until collar material is flush with top outer edges of said cutouts, said cutouts being edge positioning notches located at a predetermined distance along each of two sides of said triangular shaped member between said two bases.

* * * * *